US005887766A

United States Patent [19]

Yang

[11] Patent Number: 5,887,766

[45] Date of Patent: Mar. 30, 1999

[54] LIQUID CONTAINER WITH AIR-VENTING LID

[76] Inventor: Chih-Chen Yang, No. 161, Kung-Yuan-Hsi Rd., Ping-Tung City, Taiwan

[21] Appl. No.: 867,885

[22] Filed: Jun. 3, 1997

[51] Int. Cl.[6] ..... B67D 3/00; B65D 47/10

[52] U.S. Cl. ..... 222/466; 222/481.5; 222/541.6

[58] Field of Search ..... 222/481.5, 541.6, 222/153.06, 466, 465.1

[56] References Cited

U.S. PATENT DOCUMENTS

| | | | |
|---|---|---|---|
| 132,875 | 11/1872 | Stoessiger | 222/466 |
| 4,221,308 | 9/1980 | Goodall | 222/470 |
| 5,232,110 | 8/1993 | Purnell | 215/312 |

*Primary Examiner*—Andres Kashnikow
*Assistant Examiner*—Sean P. O'Hanlon
*Attorney, Agent, or Firm*—Baker & Botts, L.L.P.

[57] ABSTRACT

A liquid container includes a container body for receiving a body of liquid therein and having a top wall which is formed with an outlet and which cooperates with a surface of the liquid to form an air space therebetween, and an air-venting lid. The air-venting lid includes a tubular mount with a lower section secured to the outlet, and a transverse access plate retained in the tubular mount. The tubular mount is formed with a radial inward stop that is disposed below the access plate. The access plate has a tear line which confines a tearable central tab. The tab is formed with a vent hole and a vent tube unit which extends downwardly from the tab around the vent hole and into the container body. The tab is depressible so as to tear the tab from the access plate at the tear line and so as to force the tab to incline downwardly inside the tubular mount and move past the radial stop for retention in an opened state, thereby forming a liquid flow path to permit pouring of the liquid out of the container body when the container body is tilted, and an air flow path to permit continuous air flow into the air space of the container body when the liquid is poured out of the container body.

11 Claims, 10 Drawing Sheets

LIQUID CONTAINER WITH AIR-VENTING LID

BACKGROUND OF THE INVENTION

1. Field of the Invention

The invention relates to a liquid container, more particularly to a liquid container with an air-venting lid to facilitate pouring of liquid therefrom.

2. Description of the Related Art

Referring to FIG. 1, a conventional liquid container 1 is shown to comprise a container body 11 which confines a receiving space 110 for receiving a body of liquid 2 therein and which has a top wall that is formed with an upwardly extending tubular outlet 12. A cap 13 is mounted on the outlet 12 to close the container body 11. The outlet 12 is usually provided with a forwardly and outwardly extending radial guide flange 15. Referring to FIG. 2, in use, when it is desired to pour out the liquid 2 in the receiving space 110 of the container body 11, the cap 13 is first removed, and the container body 11 is then tilted so that the liquid 2 flows through the outlet 12. The guide flange 15 ensures smooth flow of the liquid 2 out of the container body 11.

The drawbacks of the conventional liquid container 1 are as follows:

1. As shown in FIG. 2, when the container body 11 is in the tilted position so as to pour out the liquid 2 in the receiving space 110 thereof via the outlet 12, the liquid 2 sometimes fills the outlet 12 completely and prevents the flow of air into the container body 11, thereby resulting in uneven flow of the liquid 2 through the outlet 12.
2. When pouring out the liquid 2 from the container body 11, one hand of the user grasps a handle member 16 on the top wall of the container body 11, while the other hand of the user pinches a peripheral flange 17 on a bottom end of the container body 11. It is noted that the container body 11 is relatively unstable when the flow of the liquid 2 through the outlet 12 is uneven. As such, slipping of the container body 11 from the hands of the user can easily occur when the contents of the container body 11 are being poured out.
3. The peripheral flange 17 on the bottom end of the container body 11 is not designed for handling by the user of the liquid container 1. As such, its size is relatively small and makes it difficult for the user to hold the container body 11 properly, especially when the hands of the user are wet with perspiration or when the container body 11 is filled with a relatively heavy liquid such as oil.

SUMMARY OF THE INVENTION

Therefore, the object of the present invention is to provide a liquid container with an air-venting lid to facilitate pouring of liquid therefrom.

Another object of the present invention is to provide a liquid container with an auxiliary handle unit to facilitate handling of the same.

Accordingly, the liquid container of this invention comprises:

a container body adapted to receive a body of liquid therein and having a top wall which is formed with an outlet and which cooperates with a surface of the liquid to form an air space therebetween; and an air-venting lid including a tubular mount which has a lower section secured to the outlet, and a transverse access plate which is retained in the tubular mount, the tubular mount being formed with at least one radial inward stop that is disposed below the access plate, the access plate having a tear line which confines a tearable central tab, the tab being formed with a vent hole and a vent tube unit which extends downwardly from the tab around the vent hole and into the container body, the tab being depressible so as to tear the tab from the access plate at the tear line and so as to force the tab to incline downwardly inside the tubular mount and move past the radial stop for retention in an opened state, thereby forming a liquid flow path through the air-venting lid at a clearance formed between the tubular mount and a periphery of the tab to permit pouring of the liquid out of the container body when the container body is tilted, and an air flow path through the air-venting lid at the vent hole and the vent tube unit to permit continuous air flow into the air space of the container body when the liquid is poured out of the container body.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
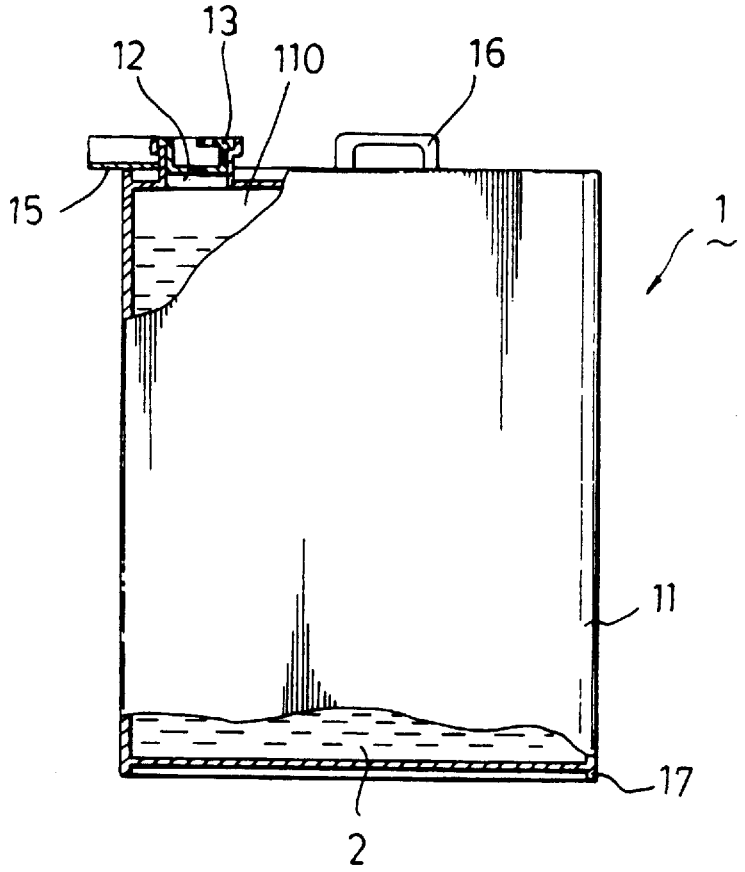
FIG. 1 PRIOR ART
FIG. 1 is a schematic partially cutaway view of a conventional liquid container.
Figure 2:
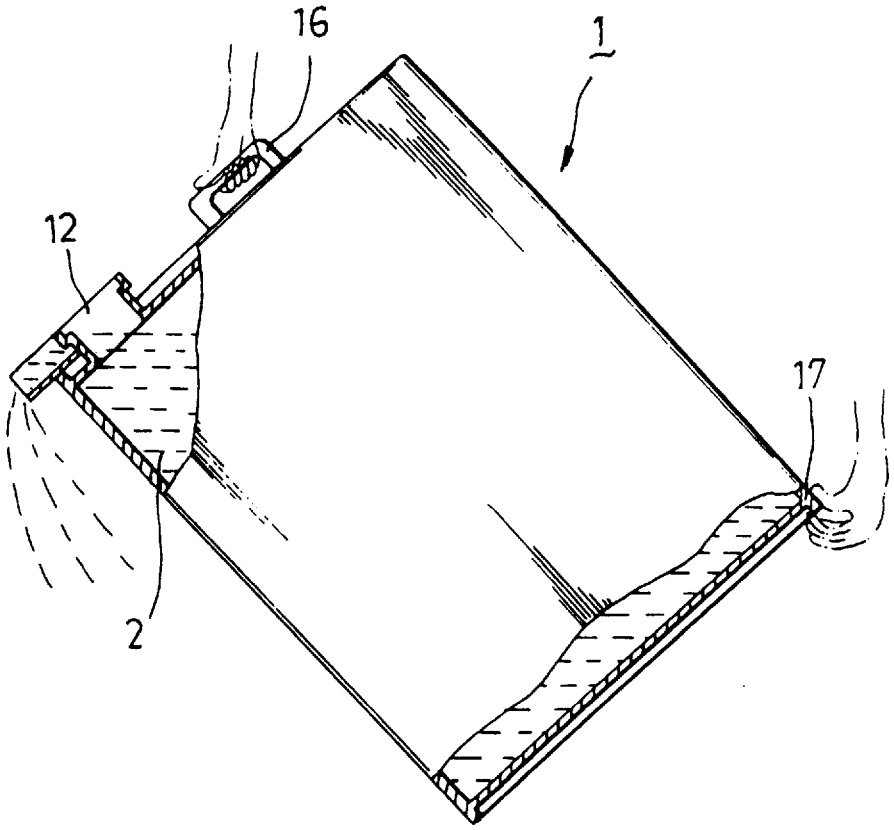
FIG. 2 PRIOR ART
FIG. 2 illustrates how liquid is poured out from the conventional liquid container of FIG. 1.

Before the present invention is described in greater detail, it should be noted that like elements are denoted by the same reference numerals throughout the disclosure.

Figure 3:
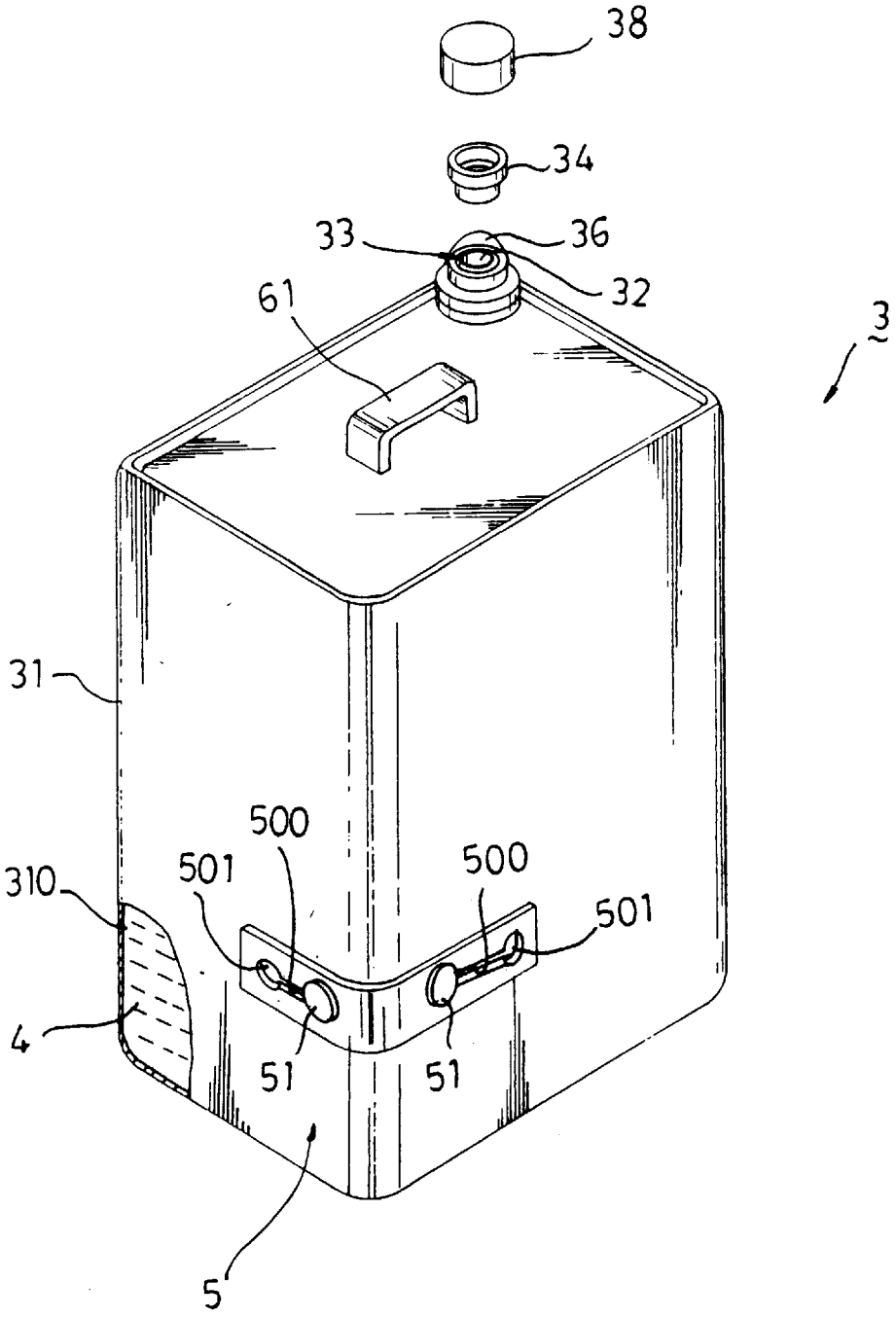
FIG. 3 is a perspective view of the first preferred embodiment of a liquid container according to the present invention.

Referring to FIG. 3, the first preferred embodiment of a liquid container 3 according to the present invention is shown to comprise a container body 31 which confines a receiving space 310 for receiving a body of liquid 4 therein and which has a top wall that is formed with an upwardly extending tubular outlet 32 provided with a forwardly and outwardly extending radial guide flange 36. The liquid container 3 further comprises an air-venting lid 33, an inner cap 34 and an outer cap 38.

Figure 4:
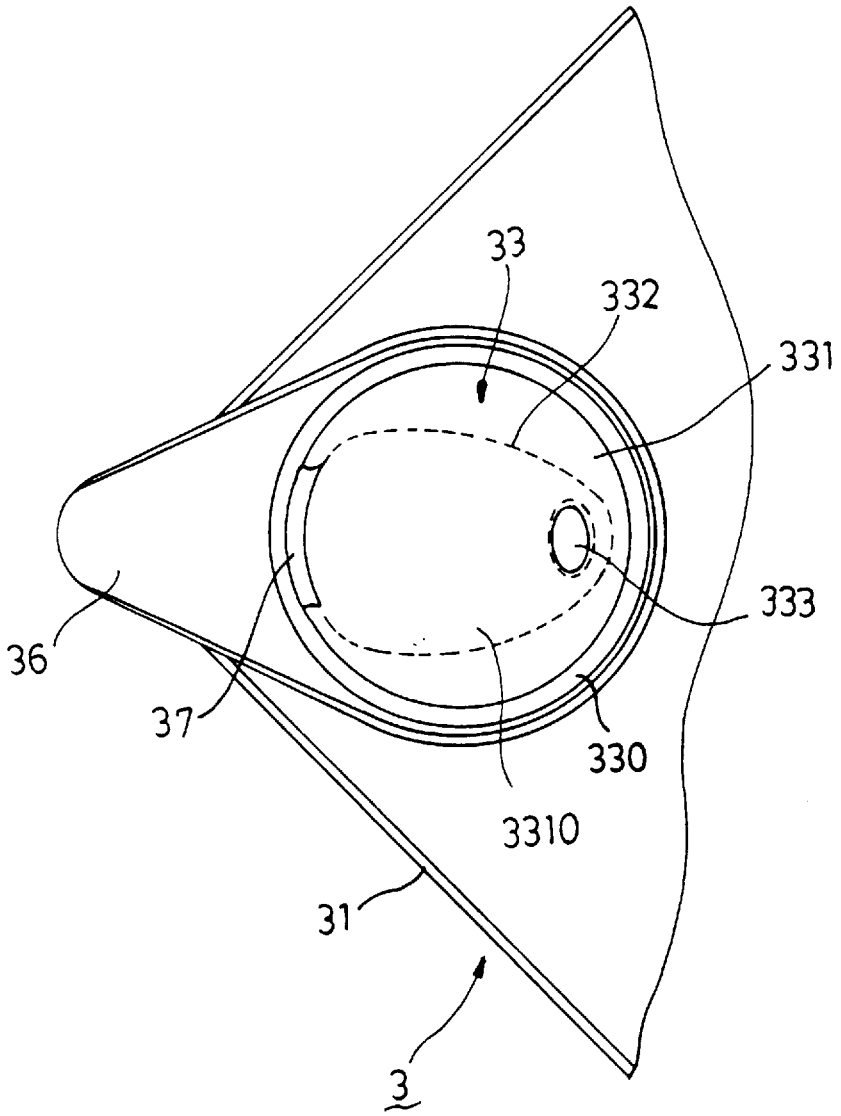
FIG. 4 is a top view which illustrates an air-venting lid of the first preferred embodiment.
Figure 5:
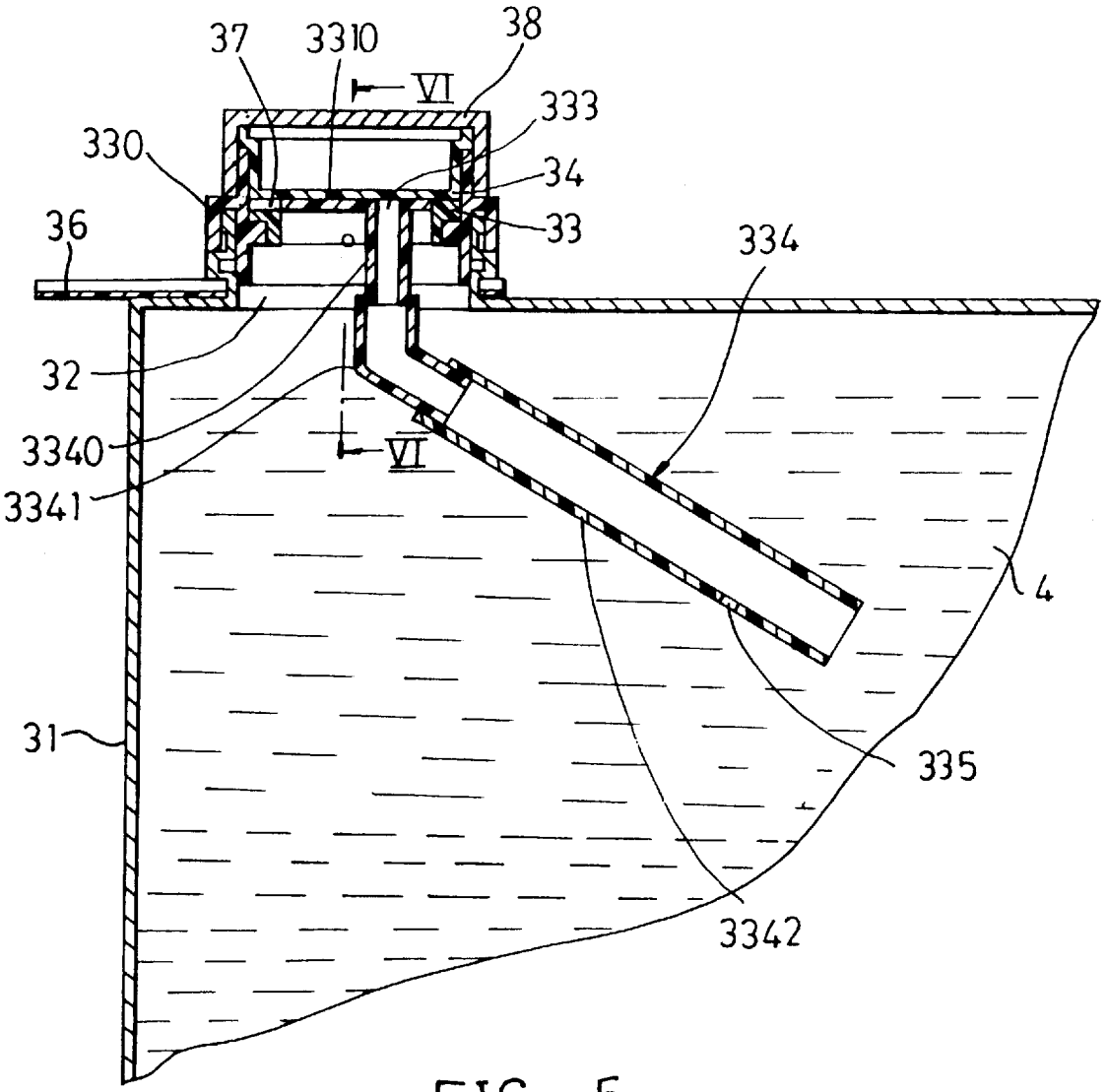
FIG. 5 is a sectional view of a top portion of the first preferred embodiment when in an initial state.
Figure 6:
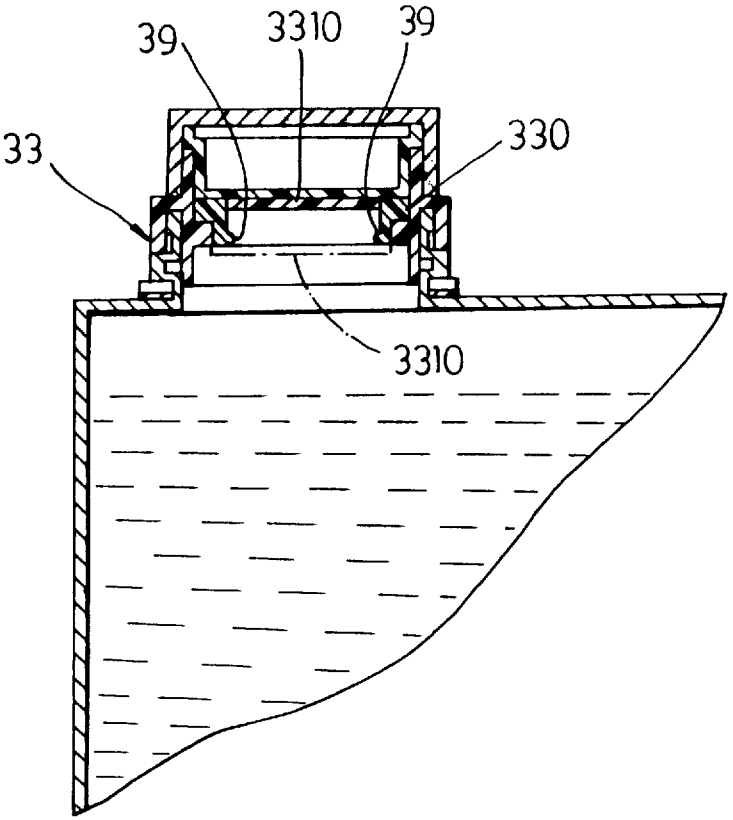
FIG. 6 is another sectional view of the top portion of the first preferred embodiment when in the initial state, taken along line VI—VI in FIG. 5.

Referring to FIGS. 4, 5 and 6, the air-venting lid 33 includes a tubular mount 330 which has a lower section secured to the outlet 32, and a transverse access plate 331 which is retained in the tubular mount 330. The tubular mount 330 is formed with a diametrically opposite pair of resilient radial inward stops 39 that are disposed below the access plate 331. The access plate 331 has a tear line 332 which confines a tearable central tab 3310. The tab 3310 can be depressed so as to tear the same from the access plate 331 at the tear line 332 and so as to force the tab 3310 to incline downwardly inside the tubular mount 330 and move past the radial stops 39 for retention in the opened state by the radial stops 39, as shown by the phantom lines in FIG. 6. The tab 3310 has a first side formed with a vent hole 333 and a vent tube unit 334 which extends from the tab 3310 and into the container body 31. In this embodiment, the vent tube unit 334 includes a first tube section 3340 which extends downwardly and integrally from the tab 3310 around the vent hole 333, a second tube section 3342 disposed in the container body 31, and an angled tubular connector 3341 which interconnects the first and second tube sections 3340, 3342. The second tube section 3342 has a bottom side formed with a radial discharge hole 335 for draining of the liquid 4 in the vent tube unit 334. The access plate 331 is further formed with a notch 37 which is adjacent to a second side of the tab 3310 opposite to the first side and which confronts the guide flange 36 to guide the flow of the liquid 4 through the outlet 32 and onto the guide flange 36. The inner cap 34 is fitted into the tubular mount 330 of the air-venting lid 33 to prevent contaminants from entering into the container body 31 via the outlet 32. The outer cap 38 is fitted over the tubular mount 330 to conceal the inner cap 34 and prevent tampering of the liquid container 3 after the latter is filled by the manufacturer.

Figure 7:
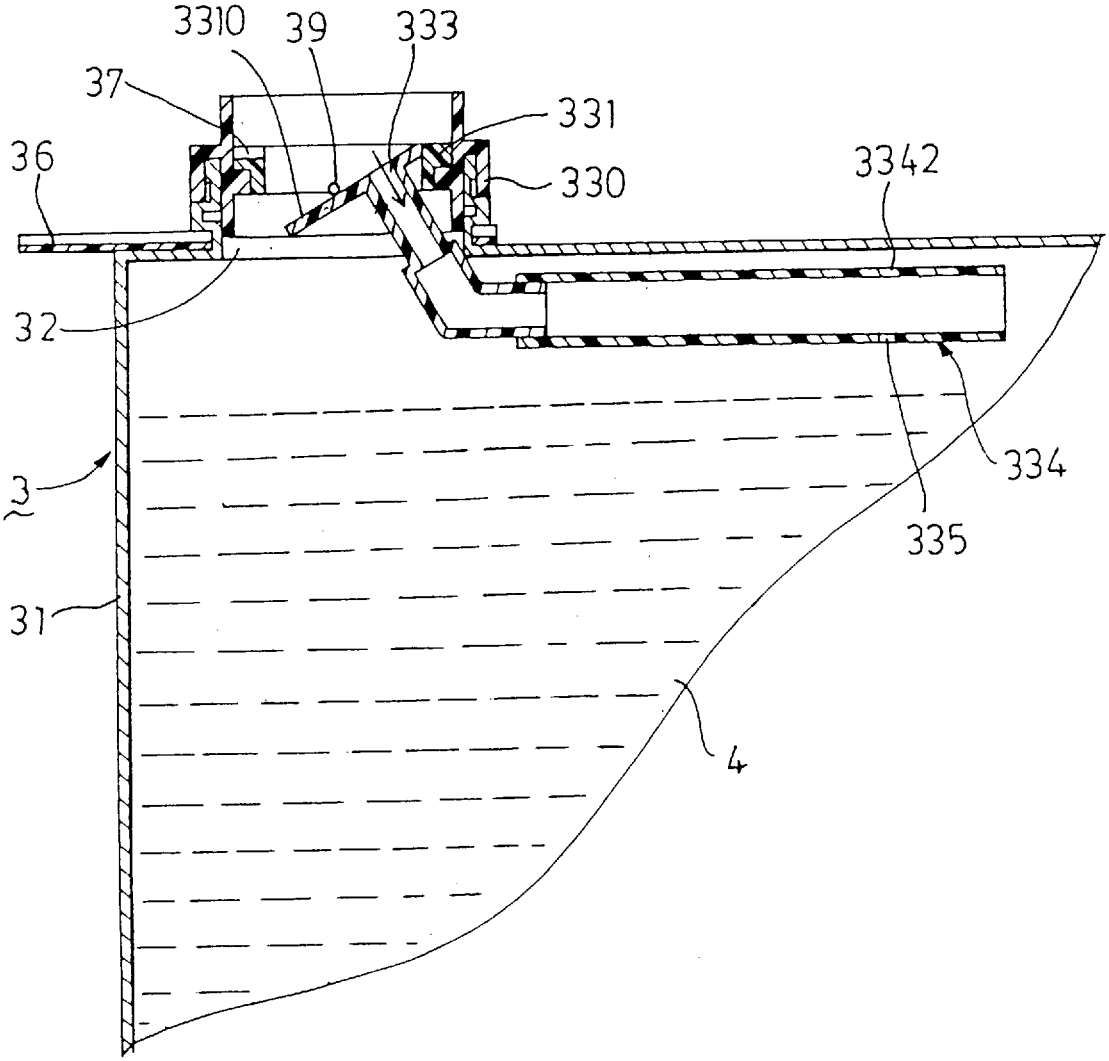
FIG. 7 is a sectional view of the top portion of the first preferred embodiment when a tab of the air-venting lid is torn.

In use, the outer and inner caps 38, 34 are removed in sequence from the air-venting lid 33. Thereafter, pressure is applied on the tab 3310 so as to tear the same from the access plate 331 at the tear line 332, and so as to move the tab 3310 past the radial stops 39 for retention in the opened state, as shown in FIG. 7. At this time, the second tube section 3342 of the vent tube unit 334 is suspended in an air space formed between the surface of the liquid 4 and the top wall of the container body 31 and is generally parallel to the top wall of the container body 31. The residual liquid 4 in the vent tube unit 334 is drained from the latter via the discharge hole 335 in the second tube section 3342.

Figure 8:
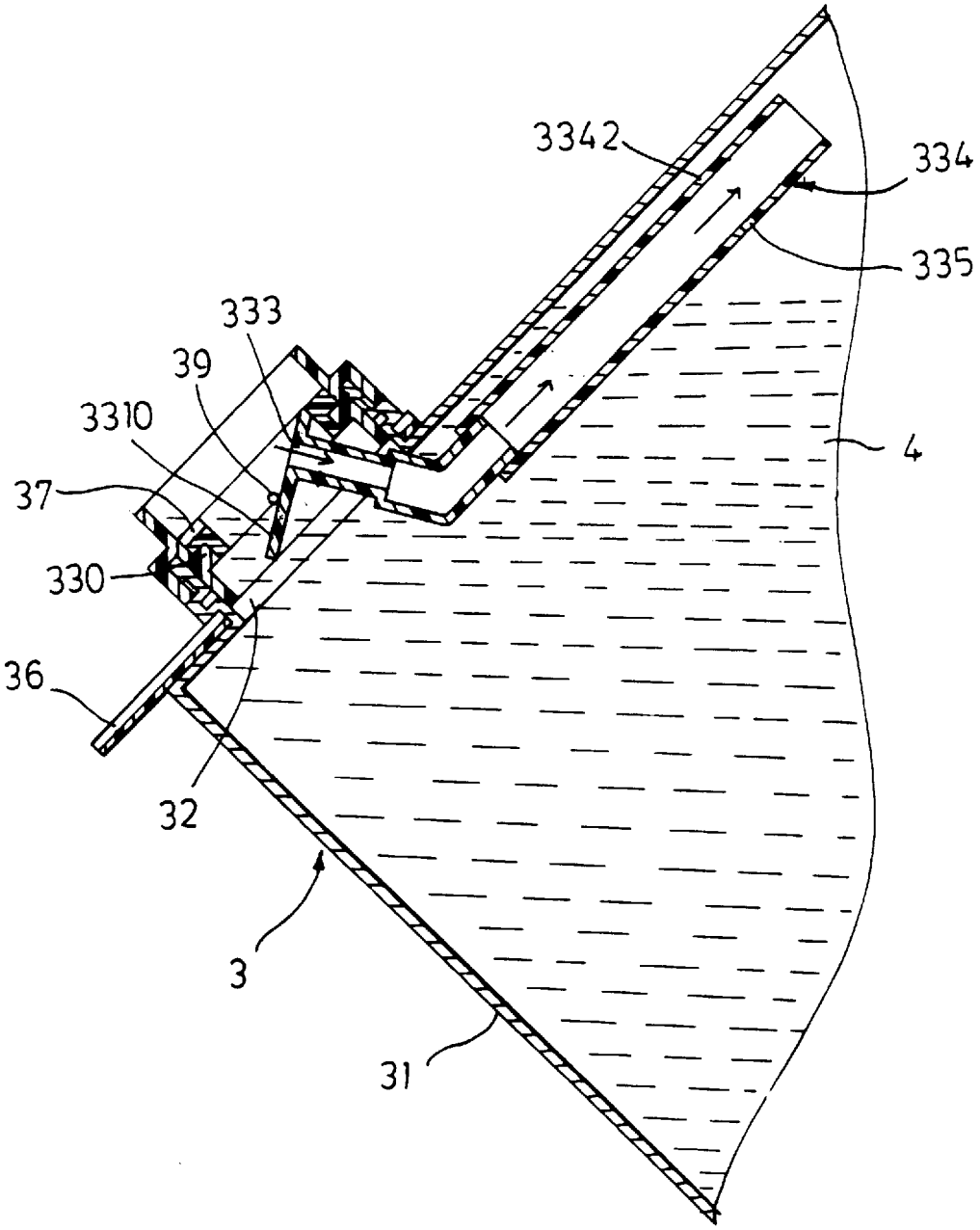
FIG. 8 is a sectional view of the top portion of the first preferred embodiment when the latter is tilted after the tab is torn for pouring out the liquid contained therein.

Referring to FIG. 8, when the container body 31 is tilted so as to pour out the liquid 4 contained therein via the outlet 32, the liquid 4 in the container body 31 forces the tab 3310 toward the radial stops 39. The air-venting lid 33 is divided into two separate fluid paths at this time. The first path is a liquid flow path through the clearance formed between the tubular mount 330 and the periphery of the tab 3310 to permit pouring of the liquid 4 out of the container body 31. The second path is an air flow path through the vent hole 333 and the vent tube unit 334 to permit continuous air flow into the container body 31 when the liquid 4 is poured out of the latter, as indicated by the arrows in FIG. 8. Note that the vent hole 333 is disposed higher than the liquid 4 flowing out of the outlet 32 to prevent the latter from entering into the vent tube unit 334. In addition, the distal end of the second tube section 3342 of the vent tube unit 334 is disposed higher than the liquid level in the container body 31 to similarly prevent the liquid 4 from entering into the vent tube unit 334. Since the residual liquid 4 in the vent tube unit 334 can be removed via the discharge hole 335, blocking of the vent tube unit 334 will not occur. As such, the liquid 4 can flow evenly out of the container 3 to make the present invention easier to handle as compared to the aforementioned prior art.

Figure 9:
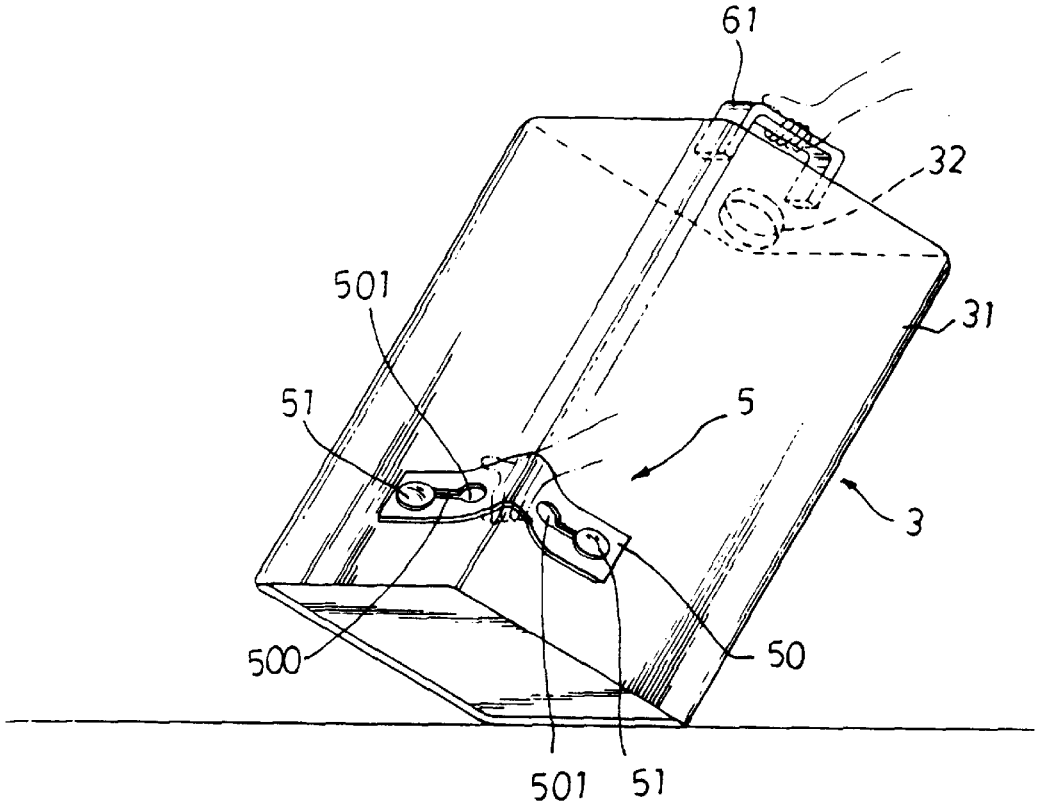
FIG. 9 is a perspective view illustrating how the first preferred embodiment can be handled during use.
Figure 10:
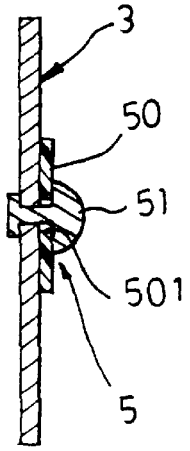
FIG. 10 is a sectional view of the first preferred embodiment, taken along line X—X in FIG. 9.

Referring again to FIG. 3, the top wall of the container body 31 has a main handle member 61 mounted thereon. The container body 31 further has a lower portion with an auxiliary handle unit 5 mounted thereon. As shown in FIGS. 9 and 10, the auxiliary handle unit 5 includes a strap 50 and a pair of retaining stubs 51, such as rivets, mounted on the lower portions of adjacent walls of the container body 31. The strap 50 has opposite end portions secured respectively to the retaining stubs 51. In this embodiment, each of the end portions of the strap 50 is formed with a longitudinal slot 500 that permits extension of a respective one of the retaining stubs 51 therethrough. Each slot 500 has opposite enlarged ends 501. Each of the retaining stubs 51 has a head portion for clamping the respective one of the end portions of the strap 50 against the container body 31.

Referring again to FIG. 3, initially, the strap 50 lies against the container body 31. When it is desired to lift the container body 31, one hand of the user grips the main handle member 61 on the top wall of the container body 31. The other hand of the user pulls the strap 50 away from the container body 31, thereby moving the strap 50 relative to the retaining stubs 51 such that the retaining stubs 51, which extend initially through inner ones of the enlarged ends 501, extend along the slots 500 to reach outer ones of the enlarged ends 501, as shown in FIG. 9. The strap 50 forms a clearance with the container body 31 at this time to permit gripping of the same by the other hand of the user. Thus, proper handling of the liquid container 3 when pouring out the contents of the same can be achieved in the present invention.

Figure 11:
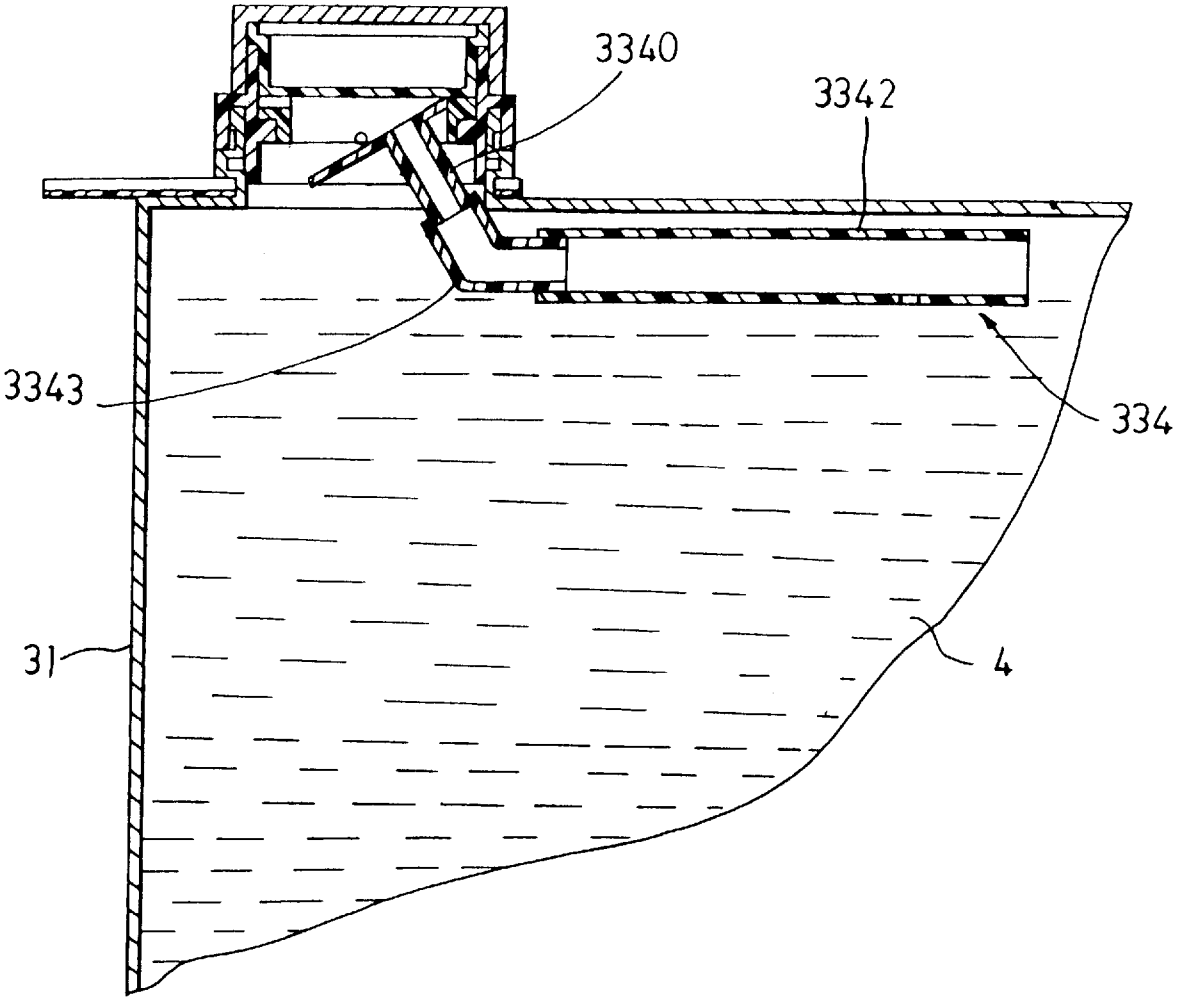
FIG. 11 is a sectional view of the top portion of the second preferred embodiment of a liquid container according to the present invention when the latter is in an initial state.

FIG. 11 illustrates the second preferred embodiment of a liquid container according to the present invention. The second preferred embodiment is generally similar to the first preferred embodiment, the main difference residing in the construction of the vent tube unit 334. Unlike the first preferred embodiment, which utilizes a rigid tubular connector 3341 for interconnecting the first and second tube sections 3340, 3342, the second preferred embodiment utilizes a flexible tubular connector 3343 to interconnect the tube sections 3340, 3342. The tubular connector 3343 enables the second tube section 3342 to float on the surface of the liquid 4 in the container body 31 so as to permit continuous air flow into the latter. The operation of the second preferred embodiment is similar to that of the previous embodiment and will not be detailed further.

The advantages of the liquid container of this invention are as follows:

1. An air-venting lid on the outlet of the liquid container has a vent tube unit on a tab which can form separate liquid and air flow paths at the outlet to ensure continuous communication between the atmosphere and the interior of the liquid container when the contents of the latter are poured out, thereby ensuring even flow of the liquid out of the liquid container. As such, the liquid container is relatively stable during the pouring operation to minimize the risk of slipping of the liquid container from the hands of the user.
2. The auxiliary handle unit on the liquid container is designed for gripping by one of the hands of the user to facilitate moving of the liquid container to another location or pouring out of the contents of the liquid container, thereby further minimizing the risk of slipping of the liquid container from the hands of the user.

3. The strap of the auxiliary handle unit can be laid against the container body when not in use so that a substantial increase in the volume of the liquid container does not occur with the provision of the auxiliary handle unit.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A liquid container comprising:

a container body adapted to receive a body of liquid therein and having a top wall which is formed with an outlet and which cooperates with a surface of the liquid to form an air space therebetween; and an air-venting lid including a tubular mount which has a lower section secured to said outlet, and a transverse access plate which is retained in said tubular mount, said tubular mount being formed with at least one radial inward stop that is disposed below said access plate, said access plate having a tear line which confines a tearable central tab, said tab being formed with a vent hole and a vent tube unit which extends downwardly from said tab around said vent hole and into said container body, said tab being depressible so as to tear said tab from said access plate at said tear line and so as to force said tab to incline downwardly inside said tubular mount and move past said radial stop for retention in an opened state, thereby forming a liquid flow path through said air-venting lid at a clearance formed between said tubular mount and a periphery of said tab to permit pouring of the liquid out of said container body when said container body is tilted, and an air flow path through said air-venting lid at said vent hole and said vent tube unit to permit continuous air flow into said air space of said container body when the liquid is poured out of said container body.

2. The liquid container as claimed in claim 1, wherein said vent tube unit includes a first tube section which extends downwardly from said tab around said vent hole, a second tube section disposed in said container body, and an angled tubular connector which interconnects said first and second tubes sections.

3. The liquid container as claimed in claim 2, wherein said second tube section has a bottom side formed with a radial discharge hole for draining of the liquid in said vent tube unit.

4. The liquid container as claimed in claim 2, wherein said tubular connector is rigid and ensures that said second tube section is suspended in said air space above the surface of the liquid and is generally parallel to said top wall of said container body.

5. The liquid container as claimed in claim 2, wherein said tubular connector is flexible and permits floating of said second tube section on the surface of the liquid to permit continuous air flow into said air space of said container body.

6. The liquid container as claimed in claim 1, wherein said vent hole is disposed on a first side of said tab, said access plate being formed with a notch adjacent to a second side of said tab opposite to said first side to guide flow of the liquid out of said container body.

7. The liquid container as claimed in claim 1, further comprising an inner cap fitted into said tubular mount of said air-venting lid.

8. The liquid container as claimed in claim 7, further comprising an outer cap fitted over said tubular mount of said air-venting lid to conceal said inner cap.

9. The liquid container as claimed in claim 1, further comprising a main handle member mounted on said top wall of said container body, and an auxiliary handle unit mounted on a lower portion of said container body, said auxiliary handle unit including a pair of retaining stubs mounted on the lower portion of said container body, and a strap having opposite end portions secured respectively to said retaining stubs, at least one of said end portions being formed with a longitudinal slot that permits extension of the respective one of said retaining stubs therethrough so as to permit movement of said strap relative to said container body between a first position, where said strap lies against said container body, and a second position, where said strap forms a clearance with said container body for gripping purposes.

10. The liquid container as claimed in claim 9, wherein said slot has opposite enlarged ends.

11. The liquid container as claimed in claim 9, wherein each of said retaining stubs has a head portion for clamping the respective one of said end portions of said strap against said container body.

* * * * *